US007145431B2

(12) United States Patent
Han et al.

(10) Patent No.: US 7,145,431 B2
(45) Date of Patent: Dec. 5, 2006

(54) THERMISTOR HAVING SYMMETRICAL STRUCTURE

(75) Inventors: Jun-Ku Han, Seoul (KR); Su-An Choi, Gyeonggi-Do (KR); Chang-Mo Ko, Gyeonggi-Do (KR); An-Na Lee, Seoul (KR); Jong-Hwan Lee, Gyeonggi-Do (KR); Ju-Dam Kim, Seoul (KR); Jong-Ho Lee, Gyeonggi-Do (KR)

(73) Assignee: LG Cable, Ltd., Seoul (KR)

( * ) Notice: Subject to any disclaimer, the term of this patent is extended or adjusted under 35 U.S.C. 154(b) by 0 days.

(21) Appl. No.: 10/724,484

(22) Filed: Nov. 28, 2003

(65) Prior Publication Data

US 2004/0108936 A1 Jun. 10, 2004

(30) Foreign Application Priority Data

Nov. 28, 2002 (KR) ..... 10-2002-0074926

(51) Int. Cl.
*H01C 7/10* (2006.01)

(52) U.S. Cl. ..... 338/22 R; 338/322

(58) Field of Classification Search ..... 338/22 R, 338/22 SD, 324, 322, 283, 284, 287; 361/103
See application file for complete search history.

(56) References Cited

U.S. PATENT DOCUMENTS 5,831,510 A * 11/1998 Zhang et al. ..... 338/22 R
5,852,397 A * 12/1998 Chan et al. ..... 338/22 R
5,907,272 A 5/1999 McGuire ..... 338/22
6,023,403 A * 2/2000 McGuire et al. ..... 361/106
6,172,592 B1 * 1/2001 Inoue et al. ..... 338/22 R
6,188,308 B1 * 2/2001 Kojima et al. ..... 338/22 R
6,236,302 B1 * 5/2001 Barrett et al. ..... 338/22 R
6,300,859 B1 * 10/2001 Myong et al. ..... 337/182
6,400,251 B1 * 6/2002 Abe et al. ..... 338/22 R
6,556,123 B1 * 4/2003 Iwao et al. ..... 338/22 R
6,640,420 B1 * 11/2003 Hetherton et al. ..... 29/612
2001/0015688 A1 * 8/2001 Li et al. ..... 338/22 R
2003/0001717 A1 * 1/2003 Zhang ..... 338/22 R
2003/0227731 A1 * 12/2003 Huang et al. ..... 361/103
2005/0062581 A1 * 3/2005 Koyama ..... 338/22 R

FOREIGN PATENT DOCUMENTS

JP 401077101 A * 3/1989 ..... 338/22 R
JP 10-106808 4/1998
KR 1998-80414 11/1998

* cited by examiner

*Primary Examiner*—Tu Hoang
(74) *Attorney, Agent, or Firm*—Fredrikson & Byron, PA

(57) ABSTRACT

A thermistor is disclosed, which comprises a resistance element having upper and lower surfaces and showing a resistance varying characteristics according to the change of temperature; first and second conductive layers formed on the upper surface of the resistance element and engaged to each other with a non-conductive gap interposed therebetween; first and second electrodes formed on the lower surface of the resistance element and electrically separated from each other; a first connector for electrically connecting the first conductive layer to the first electrode; and a second connector for electrically connecting the second conductive layer to the second electrode. Thus, the thermistor has a structurally point-symmetric shape, so it is possible to prevent the Tombstone phenomenon, caused by an asymmetric structure. Since the conductive layers having opposite polarities are engaged to each other with the non-conductive gap therebetween, the flow of current is increased and the resistance of the thermistor is decreased.

10 Claims, 10 Drawing Sheets

THERMISTOR HAVING SYMMETRICAL STRUCTURE

BACKGROUND OF THE INVENTION

1. Field of the Invention

The present invention relates to a PTC (Positive Temperature Coefficient) thermistor, and more particularly to a surface-mount PTC thermistor mounted to a PCB (Printed Circuit Board) for protecting circuits.

2. Description of the Related Art

It is well known that many conductive materials changes in their specific resistances according to the change of temperature. The element whose resistance varies according to temperature is commonly called 'a thermistor', which is generally classified into an NTC (Negative Temperature Coefficient) element showing a decrease of resistance with temperature increasing, and a PTC (Positive Temperature Coefficient) element showing an increase of resistance with temperature increasing.

The PTC element shows a low resistance at a low temperature, namely at a room temperature, so that current may pass through it. However, if the operating circumstance of the element is heated or the temperature of the element rises due to an over current, the resistance of the PTC element increases as much as 1,000 to 10,000 times of its normal resistance. Due to such properties, the PTC element is usually mounted on a PCB (Printed Circuit Board) for controlling an over current.

The PCB has many elements and components on its surface, so each component is restricted by size. Thus, there have been suggested various types of PTC elements to overcome such kind of restrictions. Most commonly, the PTC element is sandwiched between a pair of laminated electrodes.

FIG. 1 shows a PTC thermistor disclosed in U.S. Pat. No. 5,907,272. Referring to FIG. 1, a first electrode 250 and a second electrode 260 are laminated respectively on upper and lower surfaces of a PTC element 210 so that PTC element 210 is sandwiched between the electrodes. In addition, the PTC element and the first and second electrodes are surrounded by an insulating layer 280. And gaps 290 and 300 are respectively formed to expose electrodes. After the gaps are formed, one of the first and second electrodes 250 and 260 laminated on upper or lower surfaces of the PTC element is extended to the opposite surface so that the PTC thermistor can be mounted on a PCB surface. To realize it, a terminal 320 which electrically connects the gap 300 with the first electrode 250 is formed at a portion of the lower surface, while a terminal 310 which covers upper, side and lower surfaces of the insulating layer 280 and electrically connects the gap 290 with the second electrode 260 is formed at the other portion of the lower surface.

However, the above method of electrically connecting one electrode at one surface of the PTC thermistor to the other surface is apt to cause the so-called Tombstone phenomenon. When a thermistor is mounted on the PCB, the thermistor of which the terminals 310 and 320 are coated with solder cream in advance is arranged on an electrode pad of the PCB and then heated in the reflow machine. At this time, however, the heat applied to the thermistor expands the PTC element 210 and the terminals 310 and 320. Since the PTC element and the terminals have different thermal expansion coefficients and the above-described thermistor has an asymmetric configuration, thermal stress distribution is not uniform in right and left portions of the thermistor, so the thermistor is inclined on the surface of the PCB. This considerably deteriorates physical and electrical reliability of the soldering.

In addition, since the current flow mainly exists between the upper and lower surfaces in the prior art, a plurality of PTC thermistors, each having one layer, should be laminated in multi layers in order to lower the resistance of the PTC thermistor in a limited space of the PCB.

SUMMARY OF THE INVENTION

The present invention is designed to solve the problems of the prior art, and therefore an object of the present invention is to provide a PTC thermistor capable of increasing current flows at a room temperature without causing the Tombstone phenomenon when being mounted on the PCB.

In one aspect of the present invention, there is provided a thermistor, which includes a resistance element having upper and lower surfaces and showing a resistance varying characteristics according to the change of temperature; first and second conductive layers formed on the upper surface of the resistance element, the first and second conductive layers being engaged to each other with a non-conductive gap interposed therebetween; first and second electrodes formed on the lower surface of the resistance element and electrically separated from each other; a first connector for electrically connecting the first conductive layer to the first electrode; and a second connector for electrically connecting the second conductive layer to the second electrode.

Preferably, when voltage is applied to the first electrode and the second electrode, a current path is formed between the adjacent first and second conductive layers via the region where the non-conductive gap of the resistance element is formed.

Also preferably, the non-conductive gap has a width smaller than the thickness of the resistance element, the resistance element is a polymer having a positive temperature coefficient, and the first and second conductive layers are made of copper or copper alloy.

In another aspect of the invention, there is also provided a thermistor, which includes a resistance element having upper and lower surfaces and showing a resistance varying characteristics according to the change of temperature; first and second conductive layers formed on the upper surface of the resistance element, the first and second conductive layers being adjacently engaged to each other with a first non-conductive gap interposed therebetween; first and second electrodes formed on the lower surface of the resistance element, the first and second electrodes being adjacently engaged to each other with a second non-conductive gap interposed therebetween; a first connector for electrically connecting the first conductive layer to the first electrode; and a second connector for electrically connecting the second conductive layer to the second electrode.

BRIEF DESCRIPTION OF THE DRAWINGS

Other objects and aspects of the present invention will become apparent from the following description of embodiments with reference to the accompanying drawings in which.

DESCRIPTION OF THE PREFERRED EMBODIMENT

Figure 1:
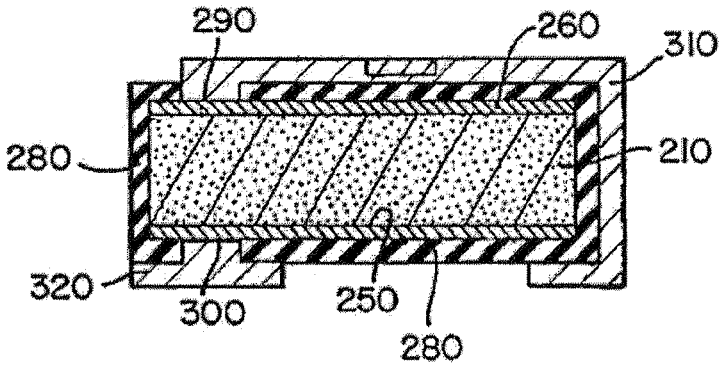
FIG. 1 is a sectional view showing a conventional PTC thermistor.

Hereinafter, the present invention will be described in more detail referring to the drawings.

Figure 2:
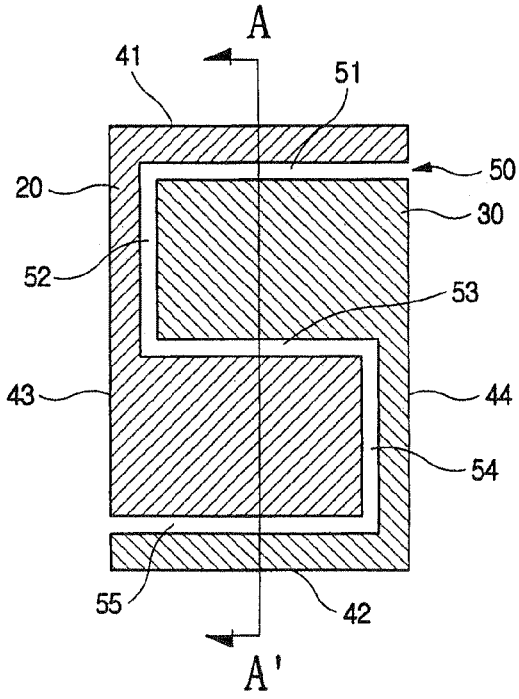
PRIOR ART FIG. 2
FIG. 2 is a top view showing a PTC thermistor according to an embodiment of the present invention.
Figure 3:
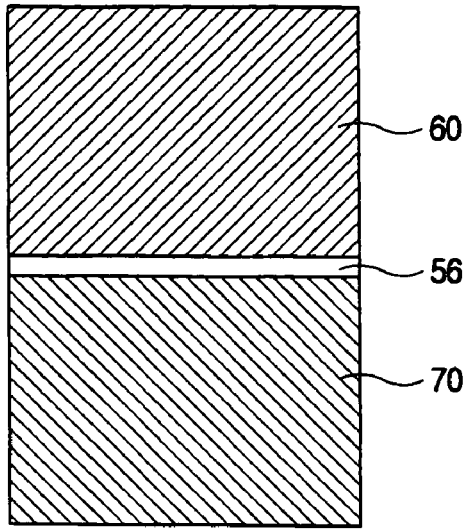
FIG. 3 is a bottom view showing a PTC thermistor according to an embodiment of the present invention.
Figure 4:
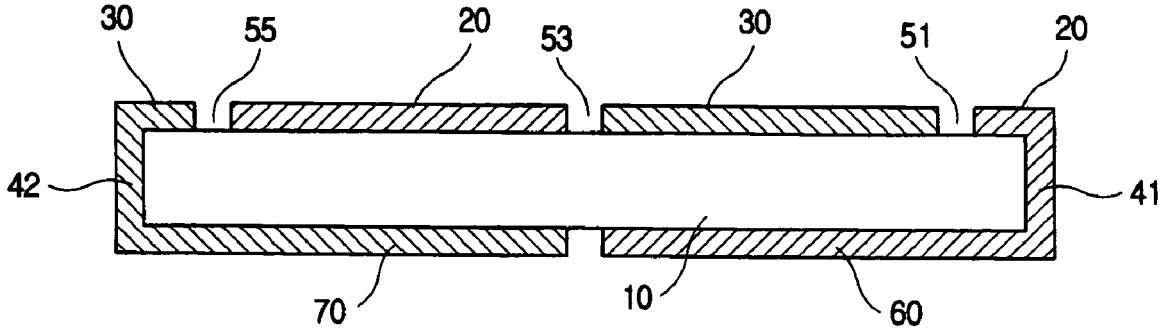
FIG. 4 is a sectional view showing the PTC thermistor of FIGS. 2 and 3, taken along the A–A' line of FIG. 2.

FIGS. 2 and 3 are respectively top and bottom views showing a PTC (Positive Temperature Coefficient) thermistor according to an embodiment of the present invention, and FIG. 4 is a sectional view showing the PTC thermistor, taken along the A–A' line of FIG. 2.

Referring to FIGS. 2 and 3, the PTC thermistor of this embodiment includes a resistance element 10 having upper and lower surfaces, conductive layers 20 and 30 laminated on the upper surface of the resistance element 10, electrodes 60 and 70 laminated on the lower surface of the resistance element 10, and connectors for connecting the conductive layers to the electrodes, respectively.

To describe the PTC thermistor in more detail, the resistance element 10 is made of PTC compound or a polymer which contains conductive particles distributed therein to have a PTC characteristic, or alternatively an NTC (Negative Temperature Coefficient) compound. The polymer may be selected from polyethylene, polypropylene, ethylene/propylene copolymer, and so on. The conductive particles may be selected from particles of carbon black or other metals.

The first and second conductive layers 20 and 30 are laminated on the upper surface of the resistance element 10. And then a non-conductive gap 50 is formed to be interposed between them so as to electrically separate the first and second conductive layers 20 and 30 from each other. To make the first and second conductive layers 20 and 30, a metal foil is at first laminated on the upper surface of the resistance element 10 as a single conductive layer by the pressing or the electrolytic and/or electroless plating. As for the metal foil, copper or copper alloy having excellent conductivity is preferably used. If the single conductive layer is formed, the non-conductive gap 50 is formed by etching or other mechanical processing to traverse the single conductive layer so that the single conductive layer is electrically divided into the first and second conductive layers 20 and 30. At this time, the non-conductive gap 50 has a width smaller than a distance between the conductive layer 20 or 30 formed on the upper surface of the resistance element 10 and the electrode 60 or 70 formed on the lower surface, that is to say a thickness of the resistance element 10, so that sufficient current flow is ensured between the adjacent conductive layers and between the adjacent electrodes, respectively formed on the same surface of the resistance element.

Preferably, the first and second conductive layers 20 and 30 are adjacently engaged to each other with the non-conductive gap 50 interposed therebetween as a border. The engagement pattern of the first and second conductive layers 20 and 30 may be shaped like concavo-convex, which is rectangular, triangular, zigzag or waved.

To describe the PTC thermistor in more detail with reference to FIG. 2, the first non-conductive gap 51 is formed adjacent to the first side 41 in parallel to the first side 41, while the second non-conductive gap 52 is bent at the end of the first non-conductive gap 51 and extended along the third side 43 so as to be perpendicular to the first non-conductive gap 51. In addition, the third non-conductive gap 53 is bent at the end of the second non-conductive gap 52 and extended in parallel to the first non-conductive gap 51. The third non-conductive gap 53 is positioned at the center on the upper surface of the resistance element 10. The fourth non-conductive gap 54 and the fifth non-conductive gap 55 are respectively formed adjacent to the fourth side 44 and a second side 42, symmetrically to the second non-conductive gap 52 and the first non-conductive gap 51 respectively based on the center point of the third non-conductive gap 53. Thus, the first conductive layer 20 is positioned adjacent to the third side 43 and the second conductive layer 30 is positioned adjacent to the fourth side 44. And non-conductive gaps from the first through to the fifth are interposed between them.

The first and second electrodes 60 and 70 are laminated on the lower surface of the resistance element 10 and electrically spaced apart from each other by a non-conductive gap 56, as shown in FIG. 3. The electrodes 60 and 70 are formed by means of the same method as the above-mentioned conductive layers 20 and 30, and not described in detail in this point.

Referring to FIG. 4 showing a section of the PTC thermistor of this embodiment taken along the A–A' line, namely a line from the first side 41 to the second side 42 in FIG. 2, the second conductive layer 30, the fifth non-conductive gap 55, the first conductive layer 20, the third non-conductive gap 53, the second conductive layer 30, the first non-conductive gap 51 and the first conductive layer 20 are positioned in order on the upper surface of the resistance element 10 from the second side 42 to the fist side 41. In other words, the first and second conductive layers 20 and 30 are positioned in turn.

In order to mount the PTC thermistor constructed as above on the PCB, the electrodes should be positioned on the same surface as mentioned in the description of the prior art. Thus, the connectors for electrically connecting the first conductive layer 20 to the first electrode 60 and the second conductive layer 30 to the second electrode 70 have to be formed on the sides of the PTC thermistor. As shown in FIG. 4, the first conductive layer 20 is disposed on the upper surface of the resistance element 10 substantially opposite and facing the second electrode 70 disposed on the lower surface of the resistance element 10. The first conductive layer 20 and second electrode 70 are positioned such that they substantially overlap each other. Similarly, FIG. 4 also shows that the second conductive layer 30 is disposed on the upper surface of the resistance element 10 substantially opposite and facing the first electrode 60 disposed on the lower surface of the resistance element 10. The second conductive layer 30 and first electrode 60 are similarly shown positioned such that they substantially overlap each other.

Figure 5A:
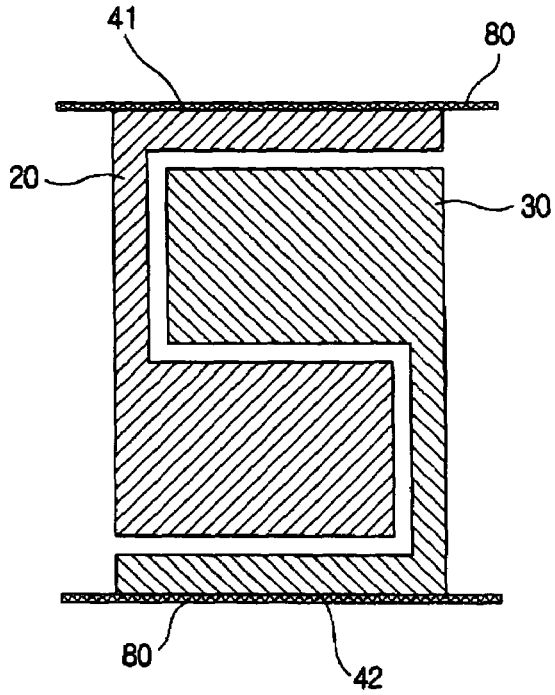
FIGS. 5*a* to 5*c* are diagrams for illustrating a method for connecting a conductive layer to an electrode according to an embodiment of the present invention.
Figure 5B:
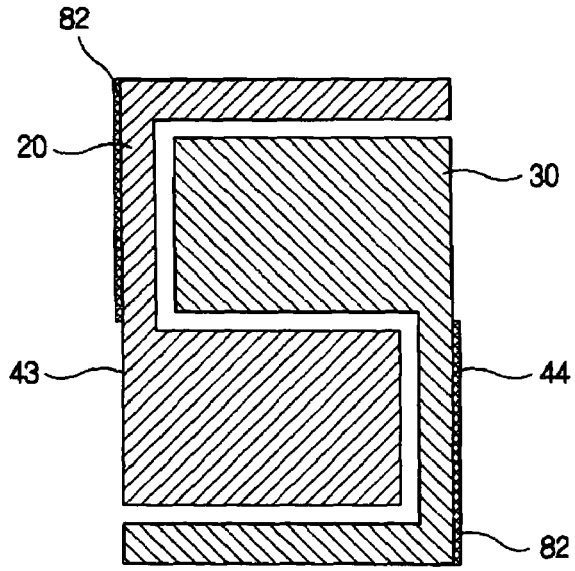
Figure 5C:
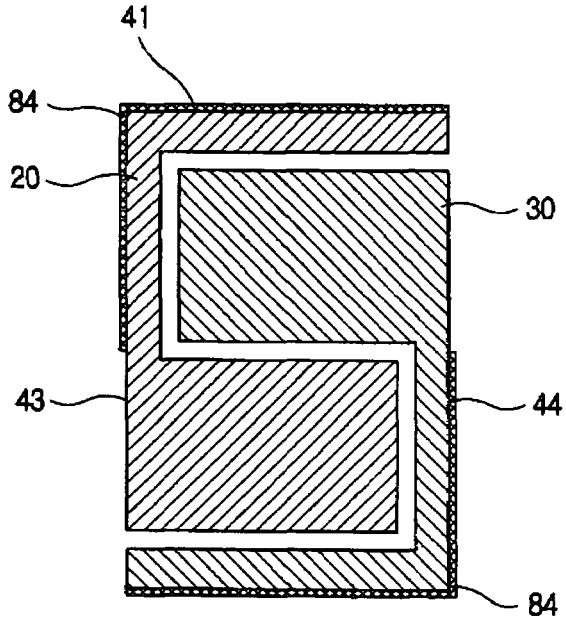

FIGS. 5*a* to 5*c* and 6*a* to 6*b* show a method for electrically connecting the conductive layers 20 and 30 formed on the upper surface of the resistance element 10 to the electrodes 60 and 70 formed on the lower surface of the resistance element 10, respectively. In order to form connectors 80, 82 and 84 shown in FIGS. 5*a* to 5*c* on a PTC element of a sheet shape having upper and lower surfaces on which the conductive layers and the electrodes are formed respectively, a slit is formed so as to expose a section of the PTC element, and then the exposed section is plated for connecting the conductive layer to the electrode. Seeing FIG. 5*a* the connector 80 is formed on the first side 41 so as to electrically connect the first conductive layer 20 on the upper surface to the first electrode 60 on the lower surface. In the same way, FIG. 5*b* shows that the connector 82 is formed on a part of the third side 43, and FIG. 5*c* shows that the connector 84 is formed on parts of the first and third sides 41 and 43 so as to electrically connect the first conductive layer 20 on the upper surface to the first electrode 60 on the lower surface. At this time, it should be noted that the connector is formed no more than the length of the first electrode 60 formed on the lower surface of the resistance element. The second conductive layer 30 and the second electrode 70 are also electrically connected to each other in the same way, of course.

Figure 6A:
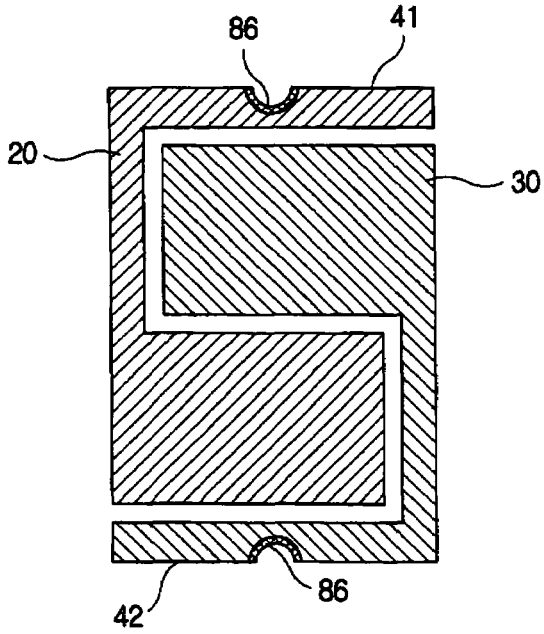
FIGS. 6*a* and 6*b* are diagrams for illustrating another method for connecting the conductive layer to the electrode according to an embodiment of the present invention.
Figure 6B:
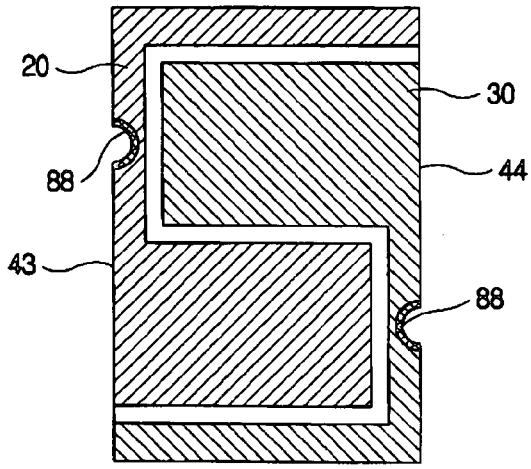

FIGS. 6*a* and 6*b* show that the conductive layer and the electrode are electrically connected by using a through hole instead of the slit of FIGS. 5*a* to 5*c*. In this embodiment, a hole is perforated in the PTC element of a sheet shape having upper and lower surfaces on which the conductive layers and the electrodes are formed respectively by using a punching or tapping machine, and then the inner surface of the hole is plated or impregnated into a lead solution so as to electrically connect the conductive layer to the electrode. Seeing FIG. 6*a* connectors 86 having a shape of a through hole are formed in the first and second sides 41 and 42 of the PTC thermistor to electrically connect the first conductive layer 20 to the first electrode 60 and the second conductive layer 30 to the second electrode 70. In addition, in case of FIG. 6*b*, connectors 88 having a shape of a through hole are formed in the third and fourth sides 43 and 44 to connect the conductive layer to the electrode.

Preferably, when electrically connecting the conductive layer to the electrode, the PTC thermistor of the present invention is configured so that components (a conductive layer and an electrode) positioned on the opposite upper and lower surfaces have opposite polarities, and the adjacent conductive layers on the upper surface as well as the adjacent electrodes on the lower surfaces have opposite polarities. This may help to increase current flows in the PTC thermistor.

Figure 7:
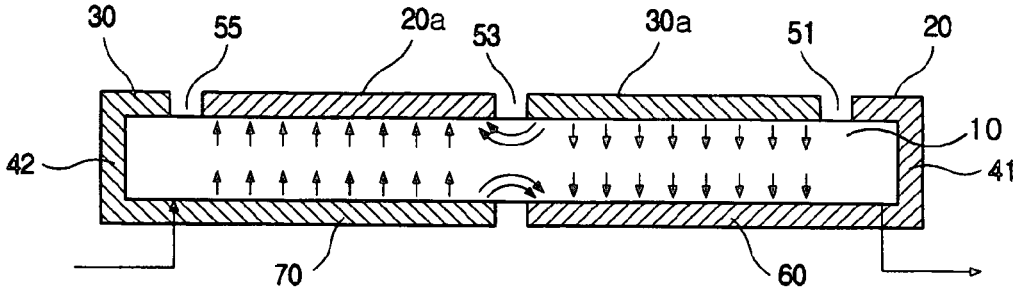
FIG. 7 is a schematic view showing a current flow in the PTC thermistor according to an embodiment of the present invention.

FIG. 7 shows an example of the current flow when a power is applied to a PCB (not shown) on which the PTC thermistor manufactured according to the embodiment of the present invention is mounted. Current flowed into the PTC thermistor through the second electrode 70 directly moves to the adjacent first electrode 60 through the resistance element 10, or moves to the opposite first conductive layer 20*a* through the PTC element 10 and then flows out to the first electrode 60 through a connector (not shown) at the side. In addition, since the current may flow faster through metals rather than through the PTC element 10, the current flowed in through the second electrode 70 partially passes through the connector at a side electrically connected to the second electrode 70 toward the second conductive layer 30*a* and then flows out to the opposite first electrode 60, or is partially flowed to the first electrode 60 through the opposite first conductive layer 20*a* via the connector at a side. In other words, the first conductive layer 20*a* and the first electrode 60 as well as the second conductive layer 30*a* and the second electrode 70 are electrically connected so that the first conductive layer 20*a* and the second electrode 70 faced to each other as well as the second conductive layer 30*a* and the first electrode 60 faced to each other may have opposite polarities and so that the first conductive layer 20*a* and the second conductive layer 30*a* as well as the first electrode 60 and the second electrode 70 may have opposite polarities.

Since the first and second conductive layers 20 and 30 which are adjacently spaced apart by means of the non-conductive layer as a border in the present invention, differently from the conventional one, the adjacent conductive layers to which voltages having opposite polarities are applied constitutes a kind of resistor together with the resistance element. In addition, since the first and second conductive layers are symmetrically arranged along the border of the non-conductive gap, it seems that many resistors are arranged in parallel to have opposite polarities in turn.

Figure 8A:
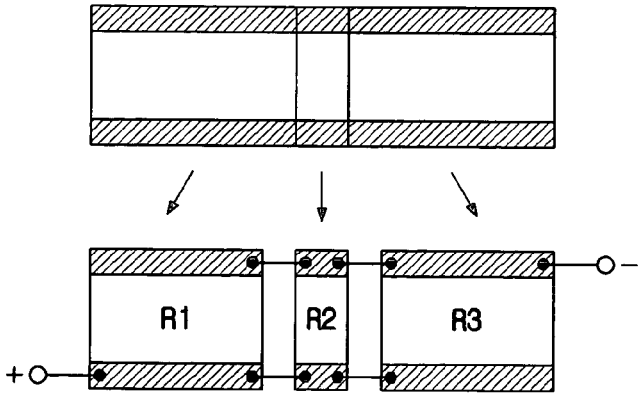
FIGS. 8*a* and 8*b* conceptually show that pluralities of the laminated PTC thermistors are connected in parallel.
Figure 8B:
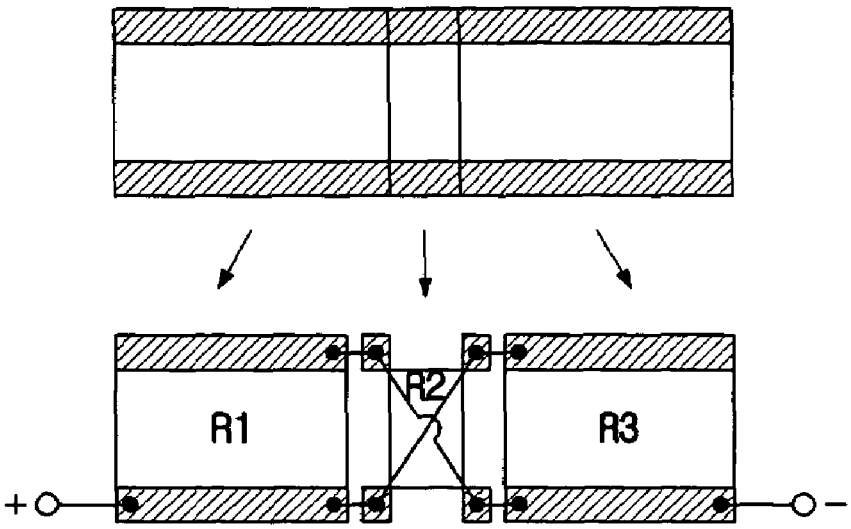
Figure 9:
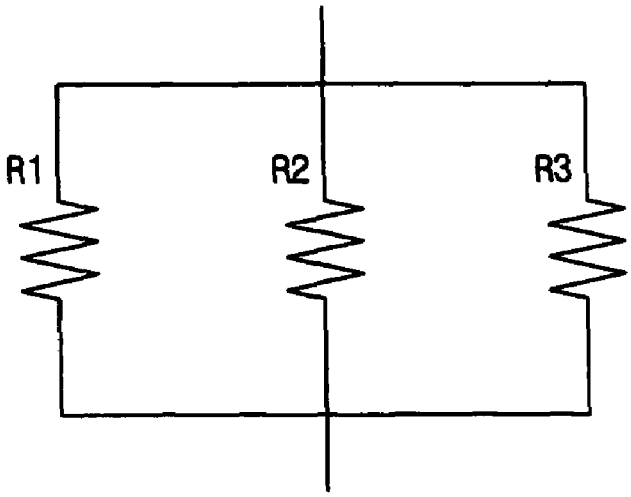
FIG. 9 is an equivalent circuit diagram of FIGS. 8*a* and 8*b;*

FIGS. 8*a* and 8*b* conceptually show a laminated PTC thermistor in which the conductive layer and the electrode are respectively divided into three portions so that the divided portions of the conductive layer and the electrode are connected to the electrode in parallel. FIG. 9 is a circuit diagram schematically showing the parallel structure of FIGS. 8*a* and 8*b*. Here, the thermistor of FIG. 8*a* is a conventional one, which is configured so that portions of the conductive layer on the upper surface are connected to each other, separately from portions of the electrode on the lower surface which are also connected among themselves. On the other hand, the thermistor of FIG. 8*b* is one having the structure according to the present invention, which is configured so that portions of the conductive layer on the upper surface and portions of the electrode on the lower surface are cross-connected.

Figure 10:
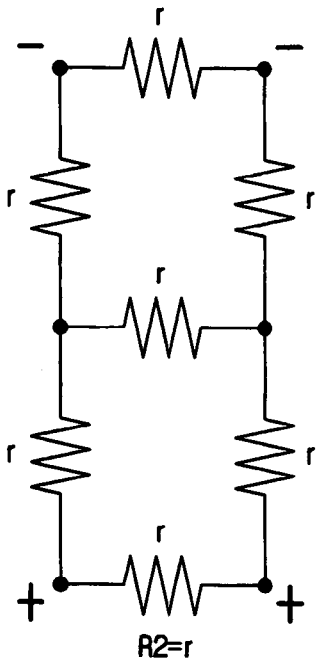
FIG. 10 is a circuit diagram for showing a resistance at $R_2$ among $R_1$, $R_2$ and $R_3$ of FIG. 9 in the connective structure of FIG. 8*a;*
Figure 11:
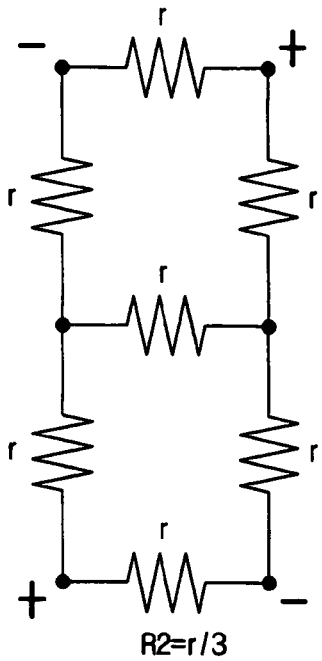
FIG. 11 is a circuit diagram showing a resistance at $R_2$ among $R_1$, $R_2$ and $R_3$ of FIG. 9 in the connective structure of FIG. 8*b;*

FIGS. 10 and 11 are circuit diagrams for calculating a resistance at $R_2$ when a current is flowed through the PTC thermistors configured according to FIGS. 8*a* and 8*b*, respectively. FIG. 10 is a circuit diagram when the portions of the conductive layers are not cross-connected as shown in FIG. 8*a*. In the circuit diagram of FIG. 10, the portions of the conductive layer or the electrode positioned on the same surface have the same polarity. Thus, though a current is applied, the current does not flow between the adjacent portions of the conductive layer or the electrode on the same surface, but the current flows only through paths formed between the conductive layer and the electrode faced to each other. The resistance at $R_2$ is calculated to become r.

On the other hand, in the circuit diagram of FIG. 11, the polarities of the portions of the conductive layer positioned at $R_2$ are alternated. Thus, if a current is applied, the current flows not only between the conductive layer and the electrode positioned on the opposite surfaces but also between the portions of the conductive layer or the electrode positioned on the same surface. This increases the number of paths through which the current may pass, so the resistance becomes dropped. At this time, the resistance at $R_2$ becomes r/3.

Figure 12:
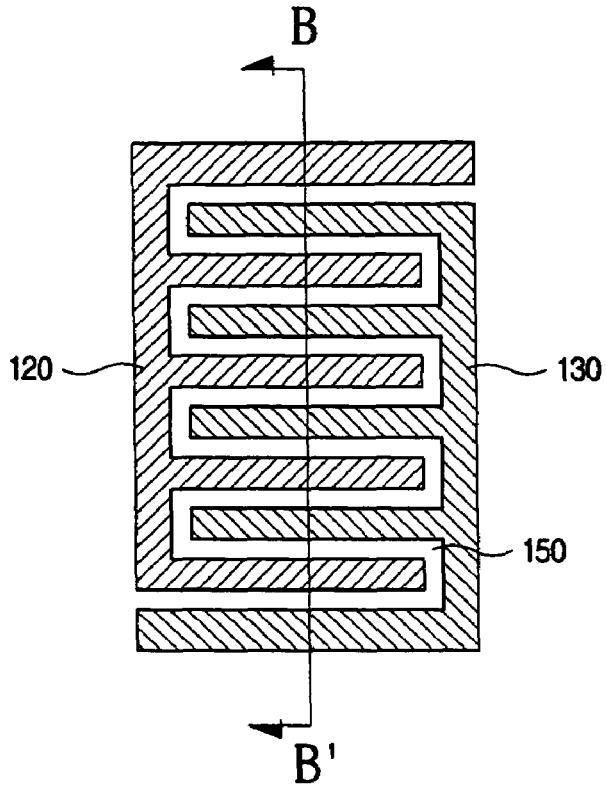
FIG. 12 is a plane view showing a PTC thermistor according to another embodiment of the present invention.
Figure 13:
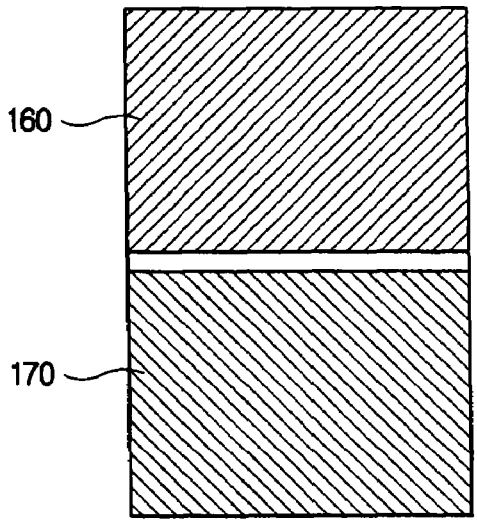
FIG. 13 is a bottom view showing a PTC thermistor according to another embodiment of the present invention.

As another embodiment of the present invention, a PTC thermistor having the further increased number of current paths is shown in FIGS. 12 and 13. In FIG. 12, a first conductive layer 120 and a second conductive layer 130, which are engaged to each other with a non-conductive gap 150 interposed therebetween on the upper surface of the resistance element, are arranged to have more rectangular concavo-convex patterns, thereby increasing current flows. FIG. 13 shows a bottom of the resistance element on which first and second electrodes 160 and 170, which are electrically separated, are formed in the same way as the former embodiment.

Figure 14:
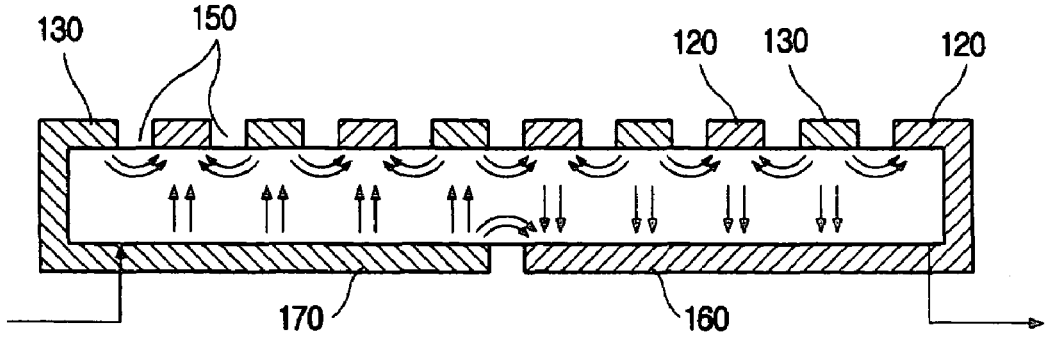
FIG. 14 is a sectional view showing the PTC thermistor of FIGS. 12 and 13, taken along the B–B' line of FIG. 12.

The current flow of the PTC thermistor is well shown in FIG. 14. FIG. 14 shows a section of the PTC thermistor, taken along the B–B' line of FIG. 12. Referring to FIG. 14, portions of the conductive layers positioned on the upper surface have opposite polarities alternatively. Thus, when a current is applied, each of the portions forms paths for the current to pass and thereby decreases a resistance. Reference numeral of FIG. 14 identical to FIGS. 12 and 13 designates the same component having the same function, which is thus not described in detail.

Figure 15:
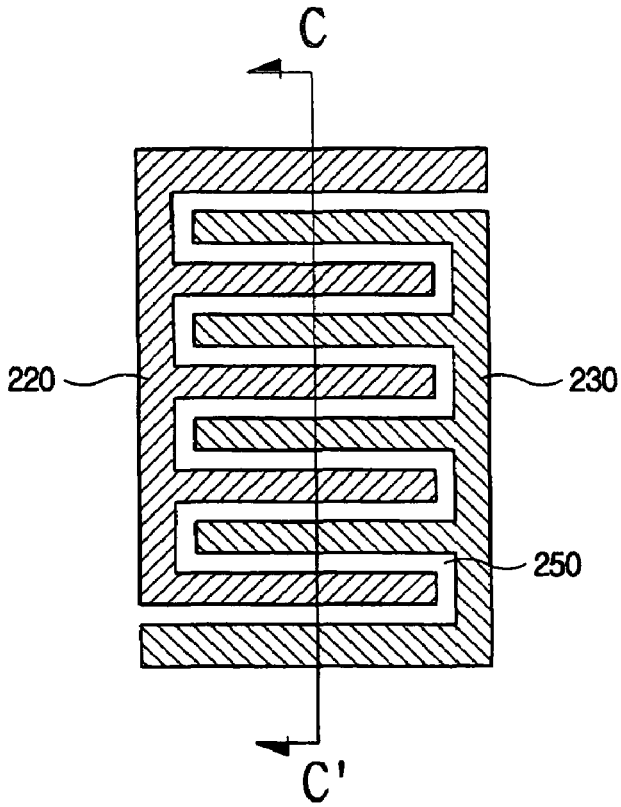
FIG. 15 is a plane view showing a PTC thermistor according to another embodiment of the present invention.
Figure 16:
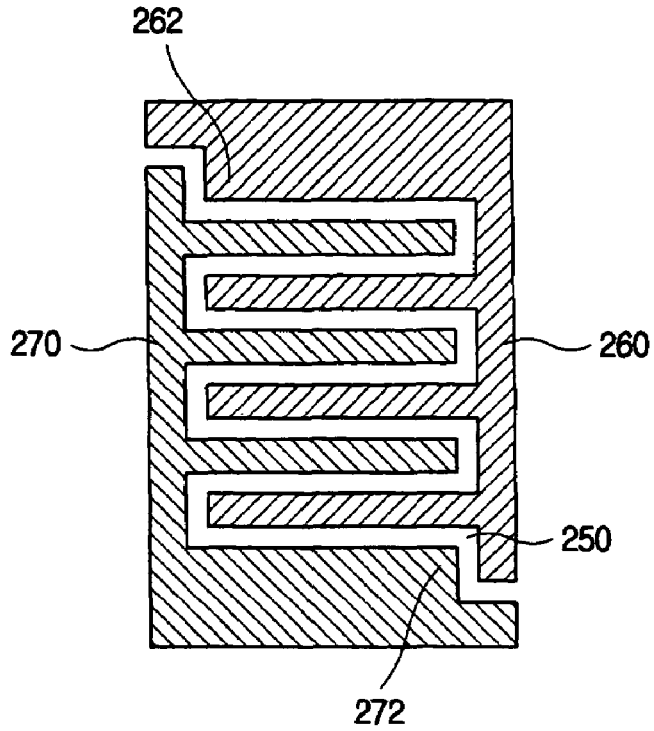
FIG. 16 is a bottom view showing a PTC thermistor according to another embodiment of the present invention.
Figure 17:
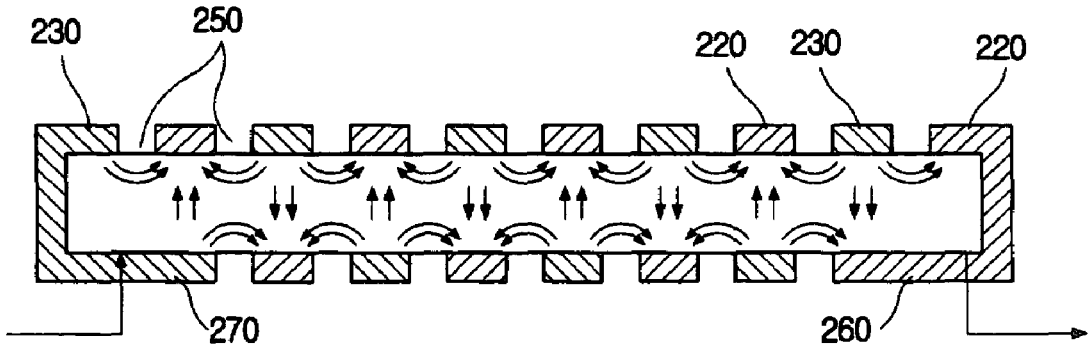
FIG. 17 is a sectional view showing the PTC thermistor of FIGS. 15 and 16, taken along the C–C' line of FIG. 15.

FIGS. 15 and 16 show a PTC thermistor according to another embodiment of the present invention. Referring to FIG. 15 showing an upper surface of the resistance element, a first conductive layer 220 and a second conductive layer 230 having opposite polarities are arranged to be engaged to each other with a non-conductive gap 250 interposed therebetween as a border. In addition, FIG. 16 shows a bottom of the resistance element on which a first electrode 260 and a second electrode 270 are formed in a planar concavo-convex pattern substantially identical to the conductive layers except both end portions 262 and 272 of the PTC thermistor at which the power is applied so that a non-conductive gap 250 is interposed between the first and second electrodes 260 and 270. This increases the number of paths through which current may pass. Thus, if a power is applied to the PTC thermistor, the current is more easily flowed through the adjacent conductive layers, thereby decreasing the resistance. On the other hand, in case the planer convavo-convex pattern is configured to have a width identical to a width of a wire on a PCB (not shown), both ends of the PTC thermistor may have the same pattern as the central portion thereof, and furthermore the pattern on the upper surface may be configured identical to the pattern on the lower surface. In addition, though it is shown that the concavo-convex pattern is horizontally shaped in the drawing, the same effect may be obtained when the patterns are vertically shaped, of course. A current flow in the PTC thermistor constructed as above is well shown in FIG. 17. FIG. 17 shows a section of the PTC thermistor, taken along the C–C' line of FIG. 15. Referring to FIG. 17, the alternatively positioned portions of the conductive layers form paths for current to flow when current is applied thereto, thereby lowering the resistance. Reference numeral in FIG. 17 identical to FIGS. 15 and 16 designate a component having the same function, so it is not described in detail here.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description. For example, though the resistance element is explained to have PTC characteristics in the above embodiments, an element having NTC characteristics may also be adopted to provide an NTC thermistor.

APPLICABILITY TO THE INDUSTRY

The thermistor according to the present invention has a structurally point-symmetric shape, so it may prevent the Tombstone phenomenon, caused by an asymmetric structure. In addition, since the conductive layers having opposite polarities are arranged to be engaged to each other with the non-conductive gap interposed therebetween, the flow of current is increased and the resistance of the thermistor is decreased.

What is claimed is:

1. A thermistor comprising:

a resistance element having upper and lower surfaces and showing a resistance varying characteristics according to the change of temperature;

first and second conductive layers formed on the upper surface of the resistance element, the first and second conductive layers being adjacently engaged to each other with a non-conductive gap interposed therebetween;

first and second electrodes formed on the lower surface of the resistance element and electrically separated from each other;

a first connector conductively electrically connecting the first conductive layer to the first electrode; and a second connector conductively electrically connecting the second conductive layer to the second electrode, wherein the first and second conductive layers and the first and second electrodes are arranged so that the first conductive layer and the second electrode face each other and substantially overlap each other with the resistance element interposed therebetween, and the second conductive layer and the first electrode face each other and substantially overlap each other with the resistance element interposed therebetween, and the non-conductive gap has a shape of concave-convex patterns.

2. A thermistor according to claim 1, wherein the resistance element is a polymer having a positive temperature coefficient.

3. A thermistor according to claim 1, wherein the first and second conductive layers are made of copper or copper alloy.

4. A thermistor according to claim 1, wherein the first and second electrodes are made of copper or copper alloy.

5. A thermistor according to claim 1, wherein the first connector electrically connects the first conductive layer to the first electrode via one side of the resistance element, while the second connector electrically connects the second conductive layer to the second electrode via the other side of the resistance element.

6. A thermistor according to claim 1, wherein the resistance element has through holes at both sides, wherein the first connector electrically connects the first conductive layer to the first electrode through the through hole at one side of the resistance element, while the second connector electrically connects the second conductive layer to the second electrode through the through hole at the other side of the resistance element.

7. A thermistor according to claim 1, wherein the shapes of the non-conductive gap is rectangular, triangular, zigzag or waved.

8. A thermistor according to claim 1, wherein the first and second electrodes are adjacently engaged to each other with a non-conductive gap interposed therebetween.

9. A thermistor according to claim 1, wherein, when voltages having opposite polarities are applied to the first electrode and the second electrode, a current path is formed between the adjacent first and second conductive layers via a region where the non-conductive gap of the resistance element is formed;

a current path is formed between the adjacent first and second electrodes via a region where the non-conductive gap of the resistance element is formed;

a current path is formed between the first conductive layer and the second electrode via the resistance element disposed therebetween; and a current path is formed between the first electrode and the second conductive layer via the resistance element disposed therebetween.

10. A thermistor according to claim 9, wherein, when voltages having opposite polarities are applied to the first electrode and the second electrode, a current path is formed between a portion of the first connector disposed adjacent the second side of the resistance element and the second conductive layer via a region where the non-conductive gap of the resistance element is formed; and a current path is formed between a portion of the second connector disposed adjacent the first side of the resistance element and the first conductive layer via a region where the non-conductive gap of the resistance element is formed.

* * * * *